US006429185B1

(12) United States Patent
Ollero Novo et al.

(10) Patent No.: US 6,429,185 B1
(45) Date of Patent: Aug. 6, 2002

(54) PROCESS FOR PRODUCING A POWDER FROM A PACKAGED TABLET

(76) Inventors: Maria del Mar Ollero Novo; Paul Irma Albertus Van Dijk; Jose Luis Vega, all of Procter & Gamble Eurocor N.V. 100 Temselaan, B-1853 Strombeek-Bever (BE)

( * ) Notice: Subject to any disclaimer, the term of this patent is extended or adjusted under 35 U.S.C. 154(b) by 0 days.

(21) Appl. No.: 09/720,409

(22) PCT Filed: Jul. 16, 1999

(86) PCT No.: PCT/US99/16077

§ 371 (c)(1),
(2), (4) Date: Dec. 20, 2000

(87) PCT Pub. No.: WO00/04127

PCT Pub. Date: Jan. 27, 2000

(51) Int. Cl.[7] ..... C11D 11/00; C11D 17/06; B02C 19/12

(52) U.S. Cl. ..... 510/445; 510/220; 510/439; 264/37.1; 264/114; 264/140

(58) Field of Search ..... 510/445, 220, 510/439; 264/37.1, 114, 140

(56) References Cited

U.S. PATENT DOCUMENTS 3,853,780 A * 12/1974 Mostow et al. ..... 510/320
5,114,647 A * 5/1992 Levesque et al. ..... 264/115
5,489,392 A 2/1996 Capeci et al. ..... 252/89.1
5,656,584 A * 8/1997 Angell et al. ..... 510/441

FOREIGN PATENT DOCUMENTS

DE 42 04 489 C1 4/1993 ..... C11D/11/00
EP 0 468 792 A1 1/1992 ..... B65B/57/10
WO WO 97/33966 A1 * 9/1997

* cited by examiner

*Primary Examiner*—Lorna M. Douyon
(74) *Attorney, Agent, or Firm*—Marianne Dressman; Kim William Zerby; Steven W. Miller

(57) ABSTRACT

The present invention relates to a process for producing a powder from a packaged tablet, the package comprising plastic materials, whereby the process is characterised in that it comprises a first step of submitting the packaged tablet to mechanical degradation with first mechanical degradation means, a second step of sifting with first sifting means to obtain an intermediate material, a third step of submitting the intermediate material to mechanical degradation with second mechanical degradation means, and a fourth step of sifting with second sifting means to obtain the powder, whereby the powder obtained comprises less than 0.05% per weight of plastic material.

10 Claims, No Drawings

PROCESS FOR PRODUCING A POWDER FROM A PACKAGED TABLET

The present invention relates to a process for producing a powder from packaged detergent tablets, especially those adapted for use in washing.

Detergent tablets are widely used in different types of washing or cleaning applications. In auto dish washing application, such tablets are produced from an original highly compressed powder having a given chemical composition, whereby the highly compressed tablet is not sensitive to mechanical stress because it is solid, and whereby the tablet readily dissolves in the dish washing machine for producing the aqueous solution comprising surfactants. In the production process of such tablets, it may occur that a low proportion of the tablet produced are not suitable for use, for example because of a non adequate chemical composition, or because of breakage on the line. In such a case, the tablets which are not suitable for use are typically recycled by crushing and dissolving the not suitable tablets to form a solution, so that a powder may be obtained from this solution, this powder being added in small proportion to the original powder to be compressed again for making tablets suitable for use.

This process is further complicated in cases of use of packaged tablets, whereby such tablets may be used also for producing powder, and whereby it should be avoided that the powder obtained contains pieces of the package. The aim is then to selectively separate the package from its content, i.e. the tablet, to avoid contamination of the obtained powder by remains of package.

The present invention concerns a process for producing a powder from a packaged tablet, the package comprising plastic materials.

Among the advantages of such a process is that it can be used for reducing waste in the environment while maintaining a satisfactory quality for the tablets to use.

While having these and other advantages, existing processes for producing a powder from a tablet, particularly the processes used for recycling auto dish washing tablets, have disadvantages. For example, such a process does not apply to the separation of the package from the tablet in cases where the tablet is packaged prior to being processed.

The invention seeks to provide a process of the above mentioned kind which allows to obtain a recycled powder which is not contaminated by packaging residues.

SUMMARY OF THE INVENTION

In accordance with the invention, this object is accomplished in a process of the above kind in that it comprises a first step of submitting the packaged tablet to mechanical degradation with first mechanical degradation means, a second step of sifting with first sifting means to obtain an intermediate material, a third step of submitting the intermediate material to mechanical degradation with second mechanical degradation means, and a fourth step of sifting with second sifting means to obtain the powder, whereby the powder obtained comprises less than 0.05% per weight of plastic material.

A process in accordance with the invention has a number of advantages. Since the recycling of the tablet is made using mechanical agitation and sifting, the recycled powder can be obtain without passing by a dissolution step, although it could be preferred to add such a step in particular conditions. Furthermore, the combination of the four steps allows to minimise the amount of plastic material contained in the obtained powder.

DETAILED DESCRIPTION OF THE INVENTION

The invention relates to a process for producing a powder from a packaged tablet. In a preferred embodiment according to the invention the tablet is having a tensile strength of at least 5 kPa, preferably the tensile strength is of at least 10 kPa, more preferably of at least 15 kPa and even more preferably of at least 20 kPa, so that the tablet is sufficiently mechanically resistant while dissolving readily. The tablet also preferably comprises surfactants, more preferably at least 2% by weight of surfactants. In a preferred embodiment according to the invention, the tablet comprises at least 10% by weight of surfactants, more preferably at least 15% and most preferably at least 20%. Indeed, the invention more particularly relates to laundry tablets, laundry tablets having a particularly high level of surfactant. The process according to the invention comprises a first step, whereby the tablet is submitted to mechanical degradation. Mechanical degradation may be obtained via different means, the preferred means for mechanical degradation being provided by centrifugation, preferably by use of a centrifugal sifter, in particular a KEK centrifugal sifter from KEMUTEC, preferably a K650. The second step of the process consists in sifting to obtain the intermediate material. Indeed, after having been submitted to mechanical degradation, the packaged tablet is not a solid block but consists in a plurality of grains or package pieces. Sifting allows to select a part of these grains or package pieces. In a preferred embodiment according to the invention, sifting in the second step is obtained by a mesh having a plurality of 8 mm diameter apertures. Preferably, the mesh size is comprised between 2 and 15 mm, more preferably between 5 and 12 mm, and most preferably between 6 and 10 mm. The rest of the grains or package pieces which is does not sift through is evacuated and is not comprised in the intermediate material. Typically, the rest of the grains or package pieces which are not submitted to the second step represents less than 1% per weight of the whole grains or package pieces. Most of this rest is formed from plastic materials. This rest is preferably not re-inserted directly at the start of the process according to the invention, but may be submitted to an extra treatment. According to the invention, the intermediate material is thereafter submitted to a third step similar to the first step, and to a fourth step similar to the second step. Preferred for the fourth step is use of a nylon sieve having apertures having a diameter comprised between 2.4 and 3.5 mm. Preferably, the mesh size or the diameter of the apertures is comprised between 1 and 6 mm, more preferably between 1.5 and 5 mm, and most preferably between 2 and 4 mm. Similarly, a part of the intermediate material is sifted, the other part being rejected. According to he invention, it was found that use of such a process allows that the obtained powder comprises less than 0.05% per weight of plastic material, preferably less than 0.03% per weight, more preferably less than 0.02%, and most preferably less than 0.01%.

In a preferred embodiment according to the invention, the intermediate material is such that it comprises less than 5% per weight of particles passing through a 150 micrometer sieve, the obtained powder being such that it comprises less than 6% per weight of particles passing through a 150 micrometer sieve. In a preferred embodiment, the obtained powder is such that it comprises less than 5% preferably less than 4% per weight of particles passing through the 150 micrometer sieve. It should be noted that the 150 micrometer sieve referred to is normally different from the sieving means used in the second step according to the invention, and that it is mentioned in the purpose of providing means for analysing the granular structure of the obtained powder or intermediate material. The minimisation of the level of fine particles allows to improve the sanitary and environmental characteristics of the obtained powder. This more particularly applies to a tablet comprising enzymes, whereby it is preferred that the enzymes components of the tablet are not broken up during the process. Breaking up of percarbonate components should also be avoided, as the stability of the finished product could be affected. Indeed, typically tablets according to the invention would be tablets which require being packed in order to stabilise their chemical evolution thanks to specific characteristics of the package, as described in the EP application of the applicant number 97202674.4 now WO99/11540. Indeed, in a preferred embodiment, the invention relates to a tablet comprising percarbonates. Furthermore, limitation of the level of fine particles allows to obtain a better dissolution for a tablet in a wash environment if a tablet is made which comprises the obtained powder.

The invention particularly applies to re-blending of non-satisfactory tablets to an original powder, whereby the powder obtained is added to an original powder to form a mixture, the added powder constituting at least 1% and up to 20% per weight of the mixture, the mixture being compressed to form a tablet. Preferably, in such a case, the powder obtained comprises a percentage per weight of particles passing through a 150 micrometer sieve which is less than twice the percentage per weight of particles passing through a 150 micrometer sieve and comprised in the original powder. Indeed, the more the obtained powder has a granular structure close to the original powder, in particular regarding fine particles, the more reliable will the re-blending process be. In such a case, the original tablet which is submitted to the process according to the invention is itself typically made by compressing the original powder, and by adding or not a coating. Typically, the invention relates to tablets having a tensile strength of less than 700 kPa. More preferred are tablets having a tensile strength of less than 150 kPa, even more preferred tablets having a tensile strength of less than 100 kPa, most preferred tablets having a tensile strength of less than 50 kPa or even less than 30 kPa. Indeed, the tablets according to the invention should readily dissolve in a washing environment, so the tablets should not be excessively compressed. It should be noted that the process according to the invention could also be considered for producing a powder from a tablet typically used for auto dish washing, although the dissolution characteristics are not so stringent as for laundry tablets, so that the invention is even more advantageous when applied to laundry tablets.

When applied industrially, the process according to the invention allows to treat a plurality of tablets at a rate of at least 100 and up to 300 kilograms per hour and per mechanical degradation and sifting means.

Tablet Package

In a preferred embodiment, the tablets of the invention comprise a bleaching agent. Typically, the bleaching agent will be an inorganic per-hydrate bleach. Such bleaching agents comprise sodium per-borate, which may be in the form of the mono-hydrate or of the tetra-hydrate. Other per-hydrate salts can also be used, such as sodium per-carbonate. Such components are a useful source of carbonate ions for detergency purposes. However, such per-carbonates are particularly unstable in moisture and also release gas, such as oxygen. Therefore, packing should to be suitable so as to take account of these two features.

Because a bleaching agent is decomposing in moisture and consequently loosing its bleaching properties, it is important to protect the tablets from ingress of external moisture. Ideally, this could be achieved by packing each tablet in a separate package to open just prior to use, the package being completely water-impermeable. In order to achieve efficient protection of the tablets, it is preferred that the packaging system has a limited Moisture Vapour Transfer Rate (MVTR). The MVTR of the packaging system is measured at 40° C. and 75% eRH, which corresponds to a environment particularly damaging for the tablets. It was found that the MVTR should not exceed 20 $g/m^2$/day in order to fulfil the requirements of the packaging system, corresponding to a protection effective for a six month period in real conditions.

The packaging system should also take account of the fact that gas may be released by its content. This may be achieved by a micro-hole which is made in the packaging system. A micro-hole would act as a communication between the inside of the packaging system and the outside of the packaging system. The main characteristics of a micro-hole is that the communication it provided is pressure sensitive. Indeed, if the pressure inside of the packaging system and the pressure outside of the packaging system are in equilibrium, the micro-hole will have a negligible influence on the transmission characteristics of the packaging system because of the resilience of the material. Indeed, no significant amount of the material is taken away when making a micro-hole, so that it will be substantially closed in the absence of a pressure gradient between the inside and the outside of the bag. However, once a pressure gradient appears, the packaging system will be slightly distorted, so that the micro-hole will open itself and allow significant communication between the outside and the inside of the package in order to minimise the pressure gradient. This means that in case of release of a gas, the inner pressure will increase, thus creating a pressure gradient which will open the micro-hole, through which the excess of gas will be evacuated. The micro-hole is acting as a discharge orifice without letting moisture enter the bag in a significant manner as the external pressure is normally always lower or equal to the inner pressure. This mechanism can be tuned by using various sizes for the micro-holes as well as by choosing the number of micro-holes needed per packaging system, taking account of the composition and of the quantity of the content of the packaging system, and taking also account of the MVTR of the packaging system. Indeed, a non zero MVTR will allow some communication between the inside and the outside of the bag.

The packaging system of the preferred embodiment is originally composed of a sheet of material (2) having the required MVTR. Materials suitable for this use include mono-layer, co-extruded or laminated films. Such films may comprise various components, such as poly-ethylene, poly-propylene, poly-styrene, poly-ethylene-terephtalate. In a most preferred embodiment of the invention, the packaging system is composed of a poly-ethylene and bi-oriented-poly-propylene co-extruded film with an MVTR of less than 1 $g/day/m^2$. The MVTR of the packaging system is preferably of less than 10 $g/day/m^2$, more preferably of less than 5 $g/day/m^2$, even more preferably of less than 1 $g/day/m^2$ and most preferably of less than 0.5 $g/day/m^2$. The film (2) may have various thicknesses. The thickness should typically be between 10 and 150 $\mu$m, preferably between 15 and 120 $\mu$m, more preferably between 20 and 100 $\mu$m, even more preferably between 25 and 80 $\mu$m and most preferably between 30 and 40 $\mu$m.

Highly Soluble Compounds

The tablet according tot he invention may further comprise a highly soluble compound to further facilitate dissolution. Such a compound could be formed from a mixture or from a single compound. A highly soluble compound is defined as follow:

A solution is prepared as follows comprising de-ionised water as well as 20 grams per liter of a specific compound:

1- 20 g of the specific compound is placed in a Sotax Beaker. This beaker is placed in a constant temperature bath set at 10° C. A stirrer with a marine propeller is placed in the beaker so that the bottom of the stirrer is at 5 mm above the bottom of the Sotax beaker. The mixer is set at a rotation speed of 200 turns per minute.

2- 980 g of the deionised water is introduced into the Sotax beaker.

3- 10 s after the water introduction, the conductivity of the solution is measured, using a conductivity meter.

4- Step 3 is repeated after 20, 30, 40, 50, 1min, 2 min, 5 min and 10 min after step 2.

5- The measurement taken at 10 min is used as the plateau value or maximum value.

The specific compound is highly soluble according to the invention when the conductivity of the solution reaches 80% of its maximum value in less than 10 seconds, starting from the complete addition of the de-ionised water to the compound. Indeed, when monitoring the conductivity in such a manner, the conductivity reaches a plateau after a certain period of time, this plateau being considered as the maximum value. Such a compound is preferably in the form of a flowable material constituted of solid particles at temperatures comprised between 10 and 80° Celsius for ease of handling, but other forms may be used such as a paste or a liquid.

Example of highly soluble compounds include Sodium di isoalkylbenzene sulphonate or Sodium toluene sulphonate.

Cohesive Effect

The tablet according to the invention could also comprise a compound or a mixture of compounds having a cohesive effect, so that the tablet could be mechanically even stronger at constant compression force. The Cohesive Effect on the particulate material of a detergent matrix is characterised by the force required to break a tablet based on the examined detergent matrix pressed under controlled compression conditions. For a given compression force, a high tablet strength indicates that the granules stuck highly together when they were compressed, so that a strong cohesive effect is taking place. Means to assess tablet strength (also refer to diametrical fracture stress) are given in Pharmaceutical dosage forms: tablets volume 1 Ed. H. A. Lieberman et al, published in 1989.

The cohesive effect induced by the highly soluble compound is measured according to the invention by comparing the tablet strength of the original base powder without highly soluble compound with the tablet strength of a powder mix which comprises 97 parts of the original base powder and 3 parts of the highly soluble compound. The highly soluble compound is added to the matrix in a form in which it is substantially free of water (water content below 10% (pref. below 5%)). The temperature of the addition is between 10 and 80 C, more pref. between 10 and 40 C.

A highly soluble compound is defined as having a cohesive effect on the particulate material according to the invention when at a given compacting force of 3000N, tablets with a weight of 50 g of detergent particulate material and a diameter of 55 mm have their tablet tensile strength increased by over 30% (preferably 60 and more preferably 100%) by means of the presence of 3% of the highly soluble compound having a cohesive effect in the base particulate material.

It should be noted that in particular when integrating a highly soluble compound having a cohesive effect on a tablet formed by compressing a particulate material comprising a surfactant, the dissolution of the tablet in an aqueous solution was significantly increased. In a preferred embodiment, at least 1% per weight of the tablet is formed from the highly soluble compound, more preferably at least 2%, even more preferably at lest 3% and most preferably at least 5% per weight of the tablet being formed from the highly soluble compound having a cohesive effect on the particulate material.

It should be noted that a composition comprising a highly soluble compound as well as a surfactant is disclosed in EP-A-0 524 075, this composition being a liquid composition.

A highly soluble compound having a cohesive effect on the particulate material allows to obtain a tablet having a higher tensile strength at constant compacting force or an equal tensile strength at lower compacting force when compared to traditional tablets. Typically, the tablet will have a tensile strength of more than 5 kPa, preferably of more than 10 kPa, more preferably, in particular for use in laundry applications, of more than 15 kPa, even more preferably of more than 30 kPa; and a tensile strength of less than 100 kPa, even more preferably of less than 80 kPa and most preferably of less than 60 kPa. Indeed, in case of laundry application, the tablets should be less compressed than in case of auto dish washing applications for example, whereby the dissolution is more readily achieved, so that in a laundry application, the tensile strength is most preferably of less than 30 kPa.

This allows to produce tablets which have a solidity and mechanical resistance comparable to the solidity or mechanical resistance of traditional tablets while having a less compact tablet thus dissolving more readily. Furthermore, as the compound is highly soluble, the dissolution of the tablet is further facilitated, resulting in a synergy leading to facilitated dissolution for a tablet according to the invention.

Tablet Manufacture

The invention allows to obtain a less compact and less dense tablet at constant compacting force when compared to a traditional detergent tablet. Detergent tablets of the present invention can be prepared simply by mixing the solid ingredients together and compressing the mixture in a conventional tablet press as used, for example, in the pharmaceutical industry. Preferably the principal ingredients, in particular gelling surfactants, are used in particulate form. Any liquid ingredients, for example surfactant or suds suppressor, can be incorporated in a conventional manner into the solid particulate ingredients. In particular for laundry tablets, the ingredients such as builder and surfactant can be spray-dried in a conventional manner and then compacted at a suitable pressure. Preferably, the tablets according to the invention are compressed using a force of less than 100000N, more preferably of less than 50000N, even more preferably of less than 5000N and most preferably of less than 3000 N. Indeed, the most preferred embodiment is a tablet suitable for laundry compressed using a force of less than 2500N, but tablets for auto dish washing may also be considered for example, whereby such auto dish washing tablets are usually more compressed than laundry tablets.

The particulate material used for making the tablet of this invention can be made by any particulation or granulation process. An example of such a process is spray drying (in a co-current or counter current spray drying tower) which typically gives low bulk densities 600 g/l or lower. Particulate materials of higher density can be prepared by granulation and densification in a high shear batch mixer/granulator or by a continuous granulation and densification process (e.g. using Lodige® CB and/or Lodige® KM mixers). Other suitable processes include fluid bed processes, compaction processes (e.g. roll compaction), extrusion, as well as any particulate material made by any chemical process like flocculation, crystallisation sentering, etc. Individual particles can also be any other particle, granule, sphere or grain.

The components of the particulate material may be mixed together by any conventional means. Batch is suitable in, for example, a concrete mixer, Nauta mixer, ribbon mixer or any other. Alternatively the mixing process may be carried out continuously by metering each component by weight on to a moving belt, and blending them in one or more drum(s) or mixer(s). Non-gelling binder can be sprayed on to the mix of some, or all of, the components of the particulate material. Other liquid ingredients may also be sprayed on to the mix of components either separately or premixed. For example perfume and slurries of optical brighteners may be sprayed. A finely divided flow aid (dusting agent such as zeolites, carbonates, silicas) can be added to the particulate material after spraying the binder, preferably towards the end of the process, to make the mix less sticky.

The tablets may be manufactured by using any compacting process, such as tabletting, briquetting, or extrusion, preferably tabletting. Suitable equipment includes a standard single stroke or a rotary press (such as Courtoy®, Korch®, Manesty®, or Bonals®). The tablets prepared according to this invention preferably have a diameter of between 20 mm and 60 mm, preferably of at least 35 and up to 55 mm, and a weight between 25 and 100 g. The ratio of height to diameter (or width) of the tablets is preferably greater than 1:3, more preferably greater than 1:2. The compaction pressure used for preparing these tablets need not exceed 100000 $kN/m^2$, preferably not exceed 30000 $kN/m^2$, more preferably not exceed 5000 $kN/m^2$, even more preferably not exceed 3000$kN/m^2$ and most preferably not exceed 1000 $kN/m^2$. In a preferred embodiment according to the invention, the tablet has a density of at least 0.9 g/cc, more preferably of at least 1.0 g/cc, and preferably of less than 2.0 g/cc, and more preferably of less than 1.5 g/cc.

Hydrotrope Compound

In a preferred embodiment of the invention, the tablet also comprises a hydrotrope compound which is further favouring dissolution of the tablet in an aqueous solution, a specific compound being defined as being hydrotrope as follows (see S. E. Friberg and M. Chiu, J. Dispersion Science and Technology, 9(5&6), pages 443 to 457, (1988–1989)):

1. A solution is prepared comprising 25% by weight of the specific compound and 75% by weight of water.
2. Octanoic Acid is thereafter added to the solution in a proportion of 1.6 times the weight of the specific compound in solution, the solution being at a temperature of 20° Celsius. The solution is mixed in a Sotax beaker with a stirrer with a marine propeller, the propeller being situated at about 5 mm above the bottom of the beaker, the mixer being set at a rotation speed of 200 rounds per minute.
3. The specific compound is hydrotrope if the Octanoic Acid is completely solubilised, i.e . if the solution comprises only one phase, the phase being a liquid phase.

It should be noted that in a preferred embodiment of the invention, the hydrotrope compound is a flowable material made of solid particles at operating conditions between 15 and 600° Celsius.

Hydrotrope compounds include the compounds listed thereafter: A list of commercial hydrotropes could be found in McCutcheon's Emulsifiers and Detergents published by the McCutcheon division of Manufacturing Confectioners Company. Compounds of interest also include:

1. Nonionic hydrotrope with the following structure:

R—O—(CH2CH2O)x(CH—CH2O)yHCH3 where R is a C8–C10 alkyl chain, x ranges from 1 to 15, y from 3 to 10.

2. Anionic hydrotropes such as alkali metal aryl sulfonates. This includes alkali metal salts of benzoic acid, salicylic acid, bezenesulfonic acid and its many derivatives, naphthoic acid and various hydroaromatic acids. Examples of these are sodium, potassium and ammonium benzene sulfonate salts derived from toluene sulfonic acid, xylene sulfonic acid, cumene sulfonic acid, tetralin sulfonic acid, naphtalene sulfonic acid, methyl- naphtalene sulfonic acid, dimethyl naphtalene sulfonic acid, trimethyl naphtalene sulfonic acid.

Other examples include salts of dialkyl benzene sulfonic acid such as salts of di-isopropyl benzene sulfonic acid, ethyl methyl benzene sulfonic acid, alkyl benzene sulfonic acid with an alkyl chain length with 3 to 10, (pref. 4 to 9), linear or branched alkyl sulfonates with an alkyl chain with 1 to 18 carbons.

3. Solvent hydrotropes such as alkoxylated glycerines and alkoxylated glycerides, esters slakoxylated glycerines, alkoxylated fatty acids, esters of glycerin, polyglycerol esters. Preferred alkoxylated glycerines have the following structure:

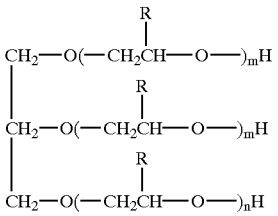

where l, m and n are each a number from 0 to about 20, with l+m+n=from about 2 to about 60, preferably from about 10 to about 45 and R represents H, $CH_3$ or $C_2H_5$.

Preferred alkoxylated glycerides have the following structure

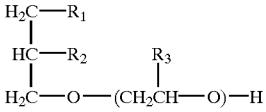

where R1 and R2 are each $C_nCOO$ or —(CH2CHR$_3$—O)$_l$—H where $R_3$=H, $CH_3$ or $C_2H_5$ and l is a number from 1 to about 60, n is a number from about 6 to about 24.

4. Polymeric hydrotropes such as those described in EP636687:

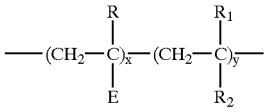

where E is a hydrophilic functional group,

R is H or a C1–C10 alkyl group or is a hydrophilic functional group;

R1 is H a lower alkyl group or an aromatic group,

R2 is H or a cyclic alkyl or aromatic group.

The polymer typically has a molecular weight of between about 1000 and 1000000.

5. Hydrotrope of unusual structure such as 5-carboxy-4-hexyl-2-cyclohexene-1-yl octanoic acid (Diacid®)

Use of such compound in the invention would further increase the dissolution rate of the tablet, as a hydrotrope compound facilitates dissolution of surfactants, for example. Such a compound could be formed from a mixture or from a single compound.

Coating

Solidity of the tablet according to the invention may be further improved by making a coated tablet, the coating covering a non-coated tablet according to the invention, thereby further improving the mechanical characteristics of the tablet while maintaining or further improving dissolution.

In one embodiment of the present invention, the tablets may then be coated so that the tablet does not absorb moisture, or absorbs moisture at only a very slow rate. The coating is also strong so that moderate mechanical shocks to which the tablets are subjected during handling, packing and shipping result in no more than very low levels of breakage or attrition. Finally the coating is preferably brittle so that the tablet breaks up when subjected to stronger mechanical shock. Furthermore it is advantageous if the coating material is dissolved under alkaline conditions, or is readily emulsified by surfactants. This contributes to avoiding the problem of visible residue in the window of a front-loading washing machine during the wash cycle, and also avoids deposition of undissolved particles or lumps of coating material on the laundry load. Water solubility is measured following the test protocol of ASTM E1148-87 entitled, "Standard Test Method for Measurements of Aqueous Solubility". Suitable coating materials are dicarboxylic acids. Particularly suitable dicarboxylic acids are selected from the group consisting of oxalic acid, malonic acid, succinic acid, glutaric acid, adipic acid, pimelic acid, suberic acid, azelaic acid, sebacic acid, undecanedioic acid, dodecanedioic acid, tridecanedioic acid and mixtures thereof.

The coating material has a melting point preferably of from 40° C. to 200° C. The coating can be applied in a number of ways. Two preferred coating methods are a) coating with a molten material and b) coating with a solution of the material.

In a), the coating material is applied at a temperature above its melting point, and solidifies on the tablet. In b), the coating is applied as a solution, the solvent being dried to leave a coherent coating. The substantially insoluble material can be applied to the tablet by, for example, spraying or dipping. Normally when the molten material is sprayed on to the tablet, it will rapidly solidify to form a coherent coating. When tablets are dipped into the molten material and then removed, the rapid cooling again causes rapid solidification of the coating material. Clearly substantially insoluble materials having a melting point below 40° C. are not sufficiently solid at ambient temperatures and it has been found that materials having a melting point above about 200° C. are not practicable to use. Preferably, the materials melt in the range from 60° C. to 160° C., more preferably from 70° C. to 120° C.

By "melting point" is meant the temperature at which the material when heated slowly in, for example, a capillary tube becomes a clear liquid. A coating of any desired thickness can be applied according to the present invention. For most purposes, the coating forms from 1% to 10%, preferably from 1.5% to 5%, of the tablet weight.

The tablet coatings of the present invention are very hard and provide extra strength to the tablet.

In a preferred embodiment of the present invention the fracture of the coating in the wash is improved by adding a disintegrant in the coating. This disintegrant will swell once in contact with water and break the coating in small pieces. This will improve the dissolution of the coating in the wash solution. The disintegrant is suspended in the coating melt at a level of up to 30%, preferably between 5% and 20%, most preferably between 5 and 10% by weight. Possible disintegrants are described in Handbook of Pharmaceutical Excipients (1986). Examples of suitable disintegrants include starch: natural, modified or pregelatinized starch, sodium starch gluconate; gum: agar gum, guar gum, locust bean gum, karaya gum, pectin gum, tragacanth gum; croscarmylose Sodium, crospovidone, cellulose, carboxymethyl cellulose, algenic acid and its salts including sodium alginate, silicone dioxide, clay, polyvinylpyrrolidone, soy polysacharides, ion exchange resins and mixtures thereof.

Tensile Strength

Depending on the composition of the starting material, and the shape of the tablets, the used compacting force may be adjusted to not affect the tensile strength, and the disintegration time in the washing machine. This process may be used to prepare homogenous or layered tablets of any size or shape. For a cylindrical tablet, the tensile strength corresponds to the diametrical fracture stress (DFS) which is a way to express the strength of a tablet, and is determined by the following equation:

$$= \frac{2F}{\pi Dt}$$

Where F is the maximum force (Newton) to cause tensile failure (fracture) measured by a VK 200 tablet hardness tester supplied by Van Kell industries, Inc. D is the diameter of the tablet, and t the thickness of the tablet. (Method Pharmaceutical Dosage Forms: Tablets Volume 2 Page 213 to 217). A tablet having a diametral fracture stress of less than 20 kPa is considered to be fragile and is likely to result in some broken tablets being delivered to the consumer. A diametral fracture stress of at least 25 kPa is preferred. Typically, the tablet according to the invention will have a tensile strength in a direction normal to the main axis of more than 5 kPa, preferably of more than 10 kPa, more preferably, in particular for use in laundry applications, of more than 15 kPa, even more preferably of more than 20 kPa. The tablet according to that invention should also dissolve readily so that it has a tensile strength preferably of less than 75 kPa, and more preferably of less than 50 kPa.

This applies similarly to non cylindrical tablets, to define the tensile strength, whereby the cross section normal to the height of the tablet is non round, and whereby the force is applied along a direction perpendicular to the direction of the height of the tablet and normal to the side of the tablet, the side being perpendicular to the non round cross section.

Tablet Dispensing

The rate of dispensing of a detergent tablet can be determined in the following way:

Two tablets, nominally 50 grams each, are weighed, and then placed in the dispenser of a Baucknecht® WA9850 washing machine. The water supply to the washing machine is set to a temperature of 20° C. and a hardness of 21 grains per gallon, the dispenser water inlet flow-rate being set to 8 l/min. The level of tablet residues left in the dispenser is checked by switching the washing on and the wash cycle set to wash program 4 (white/colors, short cycle). The dispensing percentage residue is determined as follows:

% dispensing=residue weight×100/original tablet weight The level of residues is determined by repeating the procedure 10 times and an average residue level is calculated based on the ten individual measurements. In this stressed test a residue of 40% of the starting tablet weight is considered to be acceptable. A residue of less than 30% is preferred, and less than 25% is more preferred.

It should be noted that the measure of water hardness is given in the traditional "grain per gallon" unit, whereby 0.001 mole per liter=7.0 grain per gallon, representing the concentration of $Ca^{2+}$ ions in solution.

Effervescent

In another preferred embodiment of the present invention the tablets further comprises an effervescent which is a compound further favouring dissolution of the tablet in an aqueous solution. Effervescency as defined herein means the evolution of bubbles of gas from a liquid, as the result of a chemical reaction between a soluble acid source and an alkali metal carbonate, to produce carbon dioxide gas, $$\text{i.e. } C_6H_8O_7+3NaHCO_3 \rightarrow Na_3C_6H_5O_7+3CO_2\uparrow+3H_2O$$

Further examples of acid and carbonate sources and other effervescent systems may be found in: (Pharmaceutical Dosage Forms: Tablets Volume 1 Page 287 to 291).

An effervescent may be added to the tablet mix in addition to the detergent ingredients. The addition of this effervescent to the detergent tablet improves the disintegration time of the tablet. The amount will preferably be between 5 and 20% and most preferably between 10 and 20% by weight of the tablet. Preferably the effervescent should be added as an agglomerate of the different particles or as a compact, and not as separated particles. Due to the gas created by the effervescency in the tablet, the tablet can have a higher D.F.S. and still have the same disintegration time as a tablet without effervescency. When the D.F.S. of the tablet with effervescency is kept the same as a tablet without, the disintegration of the tablet with effervescency will be faster.

Further dissolution aid could be provided by using compounds such as sodium acetate or urea. A list of suitable dissolution aid may also be found in Pharmaceutical Dosage Forms: Tablets, Volume 1, Second edition, Edited by H. A. Lieberman et al, ISBN 0-8247-8044-2.

Detersive Surfactants

Surfactant are comprised in the tablet according to the invention. The dissolution of surfactants is favoured by the addition of the highly soluble compound.

Nonlimiting examples of surfactants useful herein typically at levels from about 1% to about 55%, by weight, include the conventional $C_{11}$–$C_{18}$ alkyl benzene sulfonates ("LAS") and primary, branched-chain and random $C_{10}$–$C_{20}$ alkyl sulfates ("AS"), the $C_{10}$–$C_{18}$ secondary (2,3) alkyl sulfates of the formula $CH_3(CH_2)_x(CHOSO_3\text{-}M^+)CH_3$ and $CH_3(CH_2)_y(CHOSO_3\text{-}M^+)CH_2CH_3$ where x and (y+1) are integers of at least about 7, preferably at least about 9, and M is a water-solubilizing cation, especially sodium, unsaturated sulfates such as oleyl sulfate, the $C_{10}$–$C_{18}$ alkyl alkoxy sulfates ("$AE_xS$"; especially EO 1–7 ethoxy sulfates), $C_{10}$–$C_{18}$ alkyl alkoxy carboxylates (especially the EO 1–5 ethoxycarboxylates), the $C_{10}$–$C_{18}$ glycerol ethers, the $C_{10}$–$C_{18}$ alkyl polyglycosides and their corresponding sulfated polyglycosides, and $C_{12}$–$C_{18}$ alpha-sulfonated fatty acid esters. If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like, can also be included in the overall compositions. The $C_{10}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used. Mixtures of anionic and nonionic surfactants are especially useful. Other conventional useful surfactants are listed in standard texts. In a preferred embodiment, the tablet comprises at least 5% per weight of surfactant, more preferably at least 15% per weight, even more preferably at least 25% per weight, and most preferably between 35% and 45% per weight of surfactant.

Non Gelling Binders

Non gelling binders can be integrated to the particles forming the tablet in order to further facilitate dissolution. Such compounds are further favouring dissolution of the tablet in an aqueous solution. If non gelling binders are used, suitable non-gelling binders include synthetic organic polymers such as polyethylene glycols, polyvinylpyrrolidones, polyacrylates and water-soluble acrylate copolymers. The handbook of Pharmaceutical Excipients second edition, has the following binders classification: Acacia, Alginic Acid, Carbomer, Carboxymethylcellulose sodium, Dextrin, Ethylcellulose, Gelatin, Guar gum, Hydrogenated vegetable oil type l, Hydroxyethyl cellulose, Hydroxypropyl methylcellulose, Liquid glucose, Magnesium aluminum silicate, Maltodextrin, Methylcellulose, polymethacrylates, povidone, sodium alginate, starch and zein. Most preferable binders also have an active cleaning function in the laundry wash such as cationic polymers, i.e. ethoxylated hexamethylene diamine quaternary compounds, bishexamethylene triamines, or others such as pentaamines, ethoxylated polyethylene amines, maleic acrylic polymers.

Non-gelling binder materials are preferably sprayed on and hence have an appropriate melting point temperature below 90° C., preferably below 70° C. and even more preferably below 50° C. so as not to damage or degrade the other active ingredients in the matrix. Most preferred are non-aqueous liquid binders (i.e. not in aqueous solution) which may be sprayed in molten form. However, they may also be solid binders incorporated into the matrix by dry addition but which have binding properties within the tablet. Non-gelling binder materials are preferably used in an amount within the range from 0.1 to 15% of the composition, more preferably below 5% and especially if it is a non laundry active material below 2% by weight of the tablet. It is preferred that gelling binders, such as nonionic surfactants are avoided in their liquid or molten form.

Nonionic surfactants and other gelling binders are not excluded from the compositions, but it is preferred that they be processed into the detergent tablets as components of particulate materials, and not as liquids.

Builders

Detergent builders can optionally be included in the compositions herein to assist in controlling mineral hardness. Inorganic as well as organic builders can be used. Builders are typically used in fabric laundering compositions to assist in the removal of particulate soils. The level of builder can vary widely depending upon the end use of the composition.

Inorganic or P-containing detergent builders include, but are not limited to, the alkali metal, ammonium and alkanolammonium salts of polyphosphates (exemplified by the tripolyphosphates, pyrophosphates, and glassy polymeric meta-phosphates), phosphonates, phytic acid, silicates, carbonates (including bicarbonates and sesquicarbonates), sulphates, and aluminosilicates. However, non-phosphate builders are required in some locales. Importantly, the compositions herein function surprisingly well even in the presence of the so-called "weak" builders (as compared with phosphates) such as citrate, or in the so-called "underbuilt" situation that may occur with zeolite or layered silicate builders.

Examples of silicate builders are the alkali metal silicates, particularly those having a $SiO_2$:$Na_2O$ ratio in the range 1.6:1 to 3.2:1 and layered silicates, such as the layered sodium silicates described in U.S. Pat. No. 4,664,839, issued May 12, 1987 to H. P. Rieck. NaSKS-6 is the trademark for a crystalline layered silicate marketed by Hoechst (commonly abbreviated herein as "SKS-6"). Unlike zeolite builders, the Na SKS-6 silicate builder does not contain aluminum. NaSKS-6 has the delta-$Na_2SiO_5$ morphology form of layered silicate. It can be prepared by methods such as those described in German DE-A-3,417,649 and DE-A-3,742,043. SKS-6 is a highly preferred layered silicate for use herein, but other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used herein. Various other layered silicates from Hoechst include NaSKS-5, NaSKS-7 and NaSKS-11, as the alpha, beta and gamma forms. As noted above, the delta-$Na_2SiO_5$ (NaSKS-6 form) is most preferred for use herein. Other silicates may also be useful such as for example magnesium silicate, which can serve as a crispening agent in granular formulations, as a stabilizing agent for oxygen bleaches, and as a component of suds control systems.

Examples of carbonate builders are the alkaline earth and alkali metal carbonates as disclosed in German Patent Application No. 2,321,001 published on Nov. 15, 1973.

Aluminosilicate builders are useful in the present invention. Aluminosilicate builders are of great importance in most currently marketed heavy duty granular detergent compositions, and can also be a significant builder ingredient in liquid detergent formulations. Aluminosilicate builders include those having the empirical formula:

$$M_z(zAlO_2)_y].xH_2O$$

wherein z and y are integers of at least 6, the molar ratio of z to y is in the range from 1.0 to about 0.5, and x is an integer from about 15 to about 264. Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel, et al, issued Oct. 12, 1976. Preferred synthetic crystalline aluminosilicate ion exchange materials useful herein are available under the designations Zeolite A, Zeolite P (B), Zeolite MAP and Zeolite X. In an especially preferred embodiment, the crystalline aluminosilicate ion exchange material has the formula:

$$Na_{12}[(AlO_2)_{12}(SiO_2)_{12}].xH_2O$$

wherein x is from about 20 to about 30, especially about 27. This material is known as Zeolite A. Dehydrated zeolites (x=0–10) may also be used herein. Preferably, the aluminosilicate has a particle size of about 0.1–10 microns in diameter.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt. When utilized in salt form, alkali metals, such as sodium, potassium, and lithium, or alkanolammonium salts are preferred. Included among the polycarboxylate builders are a variety of categories of useful materials. One important category of polycarboxylate builders encompasses the ether polycarboxylates, including oxydisuccinate, as disclosed in Berg, U.S. Pat. No. 3,128,287, issued Apr. 7, 1964, and Lamberti et al, U.S. Pat. No. 3,635,830, issued Jan. 18, 1972. See also "TMS/TDS" builders of U.S. Pat. No. 4,663,071, issued to Bush et al, on May 5, 1987. Suitable ether polycarboxylates also include cyclic compounds, particularly alicyclic compounds, such as those described in U.S. Pat. Nos. 3,923,679; 3,835,163; 4,158,635; 4,120,874 and 4,102,903.

Other useful detergency builders include the ether hydroxypolycarboxylates, copolymers of maleic anhydride with ethylene or vinyl methyl ether, 1,3,5-trihydroxy benzene-2,4,6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are polycarboxylate builders of particular importance for heavy duty liquid detergent formulations due to their availability from renewable resources and their biodegradability. Citrates can also be used in granular compositions, especially in combination with zeolite and/or layered silicate builders. Oxydisuccinates are also especially useful in such compositions and combinations.

Also suitable in the detergent compositions of the present invention are the 3,3-dicarboxy4-oxa-1,6-hexanedioates and the related compounds disclosed in U.S. Pat. No. 4,566,984, Bush, issued Jan. 28, 1986. Useful succinic acid builders include the $C_5$–$C_{20}$ alkyl and alkenyl succinic acids and salts thereof. A particularly preferred compound of this type is dodecenylsuccinic acid. Specific examples of succinate builders include: laurylsuccinate, myristylsuccinate, paimitylsuccinate, 2-dodecenylsuccinate (preferred), 2-pentadecenyisuccinate, and the like. Laurylsuccinates are the preferred builders of this group, and are described in European Patent Application 86200690.5/0,200,263, published Nov. 5, 1986.

Other suitable polycarboxylates are disclosed in U.S. Pat. No. 4,144,226, Crutchfield et al, issued Mar. 13, 1979 and in U.S. Pat. No. 3,308,067, Diehl, issued Mar. 7, 1967. See also Diehl U.S. Pat. No. 3,723,322. Fatty acids, e.g., $C_{12}$–$C_{18}$ monocarboxylic acids, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

In situations where phosphorus-based builders can be used, and especially in the formulation of bars used for hand-laundering operations, the various alkali metal phosphates such as the well-known sodium tripolyphosphates, sodium pyrophosphate and sodium orthophosphate can be used. Phosphonate builders such as ethane-1-hydroxy-1,1-diphosphonate and other known phosphonates (see, for example, U.S. Pat. Nos. 3,159,581; 3,213,030; 3,422,021; 3,400,148 and 3,422,137) can also be used.

Bleach

The detergent compositions herein may optionally contain bleaching agents or bleaching compositions containing a bleaching agent and one or more bleach activators. When present, bleaching agents will typically be at levels of from about 1% to about 30%, more typically from about 5% to about 20%, of the detergent composition, especially for fabric laundering. If present, the amount of bleach activators will typically be from about 0.1% to about 60%, more typically from about 0.5% to about 40% of the bleaching composition comprising the bleaching agent-plus-bleach activator.

The bleaching agents used herein can be any of the bleaching agents useful for detergent compositions in textile cleaning, hard surface cleaning, or other cleaning purposes that are now known or become known. These include oxygen bleaches as well as other bleaching agents. Perborate bleaches, e.g., sodium perborate (e.g., mono- or tetrahydrate) can be used herein. Another category of bleaching agent that can be used without restriction encompasses percarboxylic acid bleaching agents and salts thereof. Suitable examples of this class of agents include magnesium monoperoxyphthalate hexahydrate, the magnesium salt of metachloro perbenzoic acid, 4-nonylamino-4-oxoperoxybutyric acid and diperoxydodecanedioic acid. Such bleaching agents are disclosed in U.S. Pat. No. 4,483,781, Hartman, issued Nov. 20, 1984, U.S. patent application Ser. No. 740,446, Burns et al, filed Jun. 3, 1985 now U.S. Pat. No. 4,634,551, European Patent Application 0,133,354, Banks et al, published Feb. 20, 1985, and U.S. Pat. No. 4,412,934, Chung et al, issued Nov. 1, 1983. Highly preferred bleaching agents also include 6-nonylamino-6-oxoperoxycaproic acid as described in U.S. Pat. No. 4,634,551, issued Jan. 6, 1987 to Burns et al.

Peroxygen bleaching agents can also be used. Suitable peroxygen bleaching compounds include sodium carbonate peroxyhydrate and equivalent "percarbonate" bleaches, sodium pyrophosphate peroxyhydrate, urea peroxyhydrate, and sodium peroxide. Persulfate bleach (e.g., OXONE, manufactured commercially by DuPont) can also be used.

A preferred percarbonate bleach comprises dry particles having an average particle size in the range from about 500 micrometers to about 1,000 micrometers, not more than about 10% by weight of said particles being smaller than about 200 micrometers and not more than about 10% by weight of said particles being larger than about 1,250 micrometers. Optionally, the percarbonate can be coated with silicate, borate or water-soluble surfactants. Percarbonate is available from various commercial sources such as FMC, Solvay and Tokai Denka.

Mixtures of bleaching agents can also be used.

Peroxygen bleaching agents, the perborates, the percarbonates, etc., are preferably combined with bleach activators, which lead to the in situ production in aqueous solution (i.e., during the washing process) of the peroxy acid corresponding to the bleach activator. Various nonlimiting examples of activators are disclosed in U.S. Pat. No. 4,915,854, issued Apr. 10, 1990 to Mao et al, and U.S. Pat. No. 4,412,934. The nonanoyloxybenzene sulfonate (NOBS) and tetraacetyl ethylene diamine (TAED) activators are typical, and mixtures thereof can also be used. See also U.S. Pat. No. 4,634,551 for other typical bleaches and activators useful herein.

Highly preferred amido-derived bleach activators are those of the formulae:

$$R^1\ N(R^5)C(O)R^2C(O)L \text{ or } R^1\ C(O)N(R^5)R^2C(O)L$$

wherein $R^1$ is an alkyl group containing from about 6 to about 12 carbon atoms, $R^2$ is an alkylene containing from 1 to about 6 carbon atoms, $R^5$ is H or alkyl, aryl, or alkaryl containing from about 1 to about 10 carbon atoms, and L is any suitable leaving group. A leaving group is any group that is displaced from the bleach activator as a consequence of the nucleophilic attack on the bleach activator by the perhydrolysis anion. A preferred leaving group is phenyl sulfonate.

Preferred examples of bleach activators of the above formulae include (6-octanamido-caproyl) oxybenzenesulfonate, (6-nonanamidocaproyl)oxybenzenesulfonate, (6-decanamido-caproyl)oxybenzenesulfonate, and mixtures thereof as described in U.S. Pat. No. 4,634,551, incorporated herein by reference. Another class of bleach activators comprises the benzoxazin-type activators disclosed by Hodge et al in U.S. Pat. No. 4,966,723, issued Oct. 30, 1990, incorporated herein by reference. A highly preferred activator of the benzoxazin-type is:

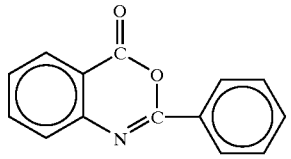

Still another class of preferred bleach activators includes the acyl lactam activators, especially acyl caprolactams and acyl valerolactams of the formulae:

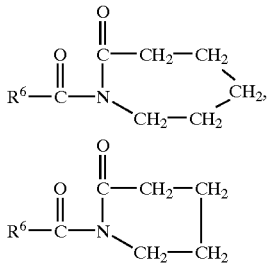

wherein $R^6$ is H or an alkyl, aryl, alkoxyaryl, or alkaryl group containing from 1 to about 12 carbon atoms. Highly preferred lactam activators include benzoyl caprolactam, octanoyl caprolactam, 3,5,5-trimethyihexanoyl caprolactam, nonanoyl caprolactam, decanoyl caprolactam, undecenoyl caprolactam, benzoyl valerolactam, octanoyl valerolactam, decanoyl valerolactam, undecenoyl valerolactam, nonanoyl valerolactam, 3,5,5-trimethylhexanoyl valerolactam and mixtures thereof. See also U.S. Pat. No. 4,545,784, issued to Sanderson, Oct. 8, 1985, incorporated herein by reference, which discloses acyl caprolactams, including benzoyl caprolactam, adsorbed into sodium perborate. Bleaching agents other than oxygen bleaching agents are also known in the art and can be utilized herein. One type of non-oxygen bleaching agent of particular interest includes photoactivated bleaching agents such as the sulfonated zinc and/or aluminum phthalocyanines. See U.S. Pat. No. 4,033,718, issued Jul. 5, 1977 to Holcombe et al. If used, detergent compositions will typically contain from about 0.025% to about 1.25%, by weight, of such bleaches, especially sulfonate zinc phthalocyanine.

If desired, the bleaching compounds can be catalyzed by means of a manganese compound. Such compounds are well known in the art and include, for example, the manganese-based catalysts disclosed in U.S. Pat. No. 5,246,621, U.S. Pat. No. 5,244,594; U.S. Pat. No. 5,194,416; U.S. Pat. No. 5,114,606; and European Pat. App. Pub. Nos. 549,271A1, 549,272A1, 544,440A2, and 544,490A1; Preferred examples of these catalysts include $Mn^{IV}{}_2(u\text{-}O)_3(1,4,7\text{-trimethyl-}1,4,7\text{-triazacyclononane})_2(PF_6)_2$, $Mn^{III}{}_2(u\text{-}O)_1(u\text{-}OAc)_2(1,4,7\text{-trimethyl-}1,4,7\text{-triazacyclononane})_2\text{-}(ClO_4)_2$, $Mn^{IV}{}_4(u\text{-}O)_6(1,4,7\text{-triazacyclononane})_4(ClO_4)_4$, $Mn^{III}Mn^{IV}{}_4(u\text{-}O)_1\ (u\text{-}OAc)_2\text{-}(1,4,7\text{-trimethyl-}1,4,7\text{-triazacyclononane})_2(ClO_4)_3$, $Mn^{IV}(1,4,7\text{-trimethyl-}1,4,7\text{-triazacyclononane})\text{-}(OCH_3)_3(PF_6)$, and mixtures thereof. Other metal-based bleach catalysts include those disclosed in U.S. Pat. No. 4,430,243 and U.S. Pat. No. 5,114,611. The use of manganese with various complex ligands to enhance bleaching is also reported in the following U.S. Pat. Nos.: 4,728,455; 5,284,944; 5,246,612; 5,256,779; 5,280,117; 5,274,147; 5,153,161; and 5,227,084.

As a practical matter, and not by way of limitation, the compositions and processes herein can be adjusted to provide on the order of at least one part per ten million of the active bleach catalyst species in the aqueous washing liquor, and will preferably provide from about 0.1 ppm to about 700 ppm, more preferably from about 1 ppm to about 500 ppm, of the catalyst species in the laundry liquor.

Enzymes

Enzymes can be included in the formulations herein for a wide variety of fabric laundering purposes, including removal of protein-based, carbohydrate-based, or triglyceride-based stains, for example, and for the prevention of refugee dye transfer, and for fabric restoration. The enzymes to be incorporated include proteases, amylases, lipases, cellulases, and peroxidases, as well as mixtures thereof. Other types of enzymes may also be included. They may be of any suitable origin, such as vegetable, animal, bacterial, fungal and yeast origin. However, their choice is governed by several factors such as pH-activity and/or stability optima, thermostability, stability versus active detergents, builders and so on. In this respect bacterial or fungal enzymes are preferred, such as bacterial amylases and proteases, and fungal cellulases.

Enzymes are normally incorporated at levels sufficient to provide up to about 5 mg by weight, more typically about 0.01 mg to about 3 mg, of active enzyme per gram of the composition. Stated otherwise, the compositions herein will typically comprise from about 0.001% to about 5%, preferably 0.01%-1% by weight of a commercial enzyme preparation. Protease enzymes are usually present in such commercial preparations at levels sufficient to provide from 0.005 to 0.1 Anson units (AU) of activity per gram of composition.

Suitable examples of proteases are the subtilisins which are obtained from particular strains of B. subtilis and B. licheniforms. Another suitable protease is obtained from a strain of Bacillus, having maximum activity throughout the pH range of 8–12, developed and sold by Novo Industries A/S under the registered trade name ESPERASE. The preparation of this enzyme and analogous enzymes is described in British Patent Specification No. 1,243,784 of Novo. Proteolytic enzymes suitable for removing protein-based stains that are commercially available include those sold under the tradenames ALCALASE and SAVINASE by Novo Industries A/S (Denmark) and MAXATASE by International Bio-Synthetics, Inc. (The Netherlands). Other proteases include Protease A (see European Patent Application 130,756, published Jan. 9, 1985) and Protease B (see European Patent Application Serial No. 87303761.8, filed Apr. 28, 1987 now EP 0,251,446, and European Patent Application 130,756, Bott et al, published Jan. 9, 1985).

Amylases include, for example, α-amylases described in British Patent Specification No. 1,296,839 (Novo), RAPIDASE, International Bio-Synthetics, Inc. and TERMAMYL, Novo Industries.

The cellulase usable in the present invention include both bacterial or fungal cellulase. Preferably, they will have a pH optimum of between 5 and 9.5. Suitable cellulases are disclosed in U.S. Pat. No. 4,435,307, Barbesgoard et al, issued Mar. 6, 1984, which discloses fungal cellulase produced from Humicola insolens and Humicola strain DSM1800 or a cellulase 212-producing fungus belonging to the genus Aeromonas, and cellulase extracted from the hepatopancreas of a marine mollusk (Dolabella Auricula Solander). suitable cellulases are also disclosed in GB-A-2.075.028; GB-A-2.095.275 and DE-OS-2.247.832. CAREZYME (Novo) is especially useful.

Suitable lipase enzymes for detergent usage include those produced by microorganisms of the Pseudomonas group, such as Pseudomonas stutzeri ATCC 19.154, as disclosed in British Patent 1,372,034. See also lipases in Japanese Patent Application 53,20487, laid open to public inspection on Feb. 24, 1978. This lipase is available from Amano Pharmaceutical Co. Ltd., Nagoya, Japan, under the trade name Lipase P "Amano," hereinafter referred to as "Amano-P." Other commercial lipases include Amano-CES, lipases ex Chromobacter viscosum, e.g. Chromobacter viscosum var. lipolyticum NRRLB 3673, commercially available from Toyo Jozo Co., Tagata, Japan; and further Chromobacter viscosum lipases from U.S. Biochemical Corp., U.S.A. and Disoynth Co., The Netherlands, and lipases ex Pseudomonas gladioli. The LIPOLASE enzyme derived from Humicola lanuginosa and commercially available from Novo (see also EPO 341,947) is a preferred lipase for use herein.

Peroxidase enzymes are used in combination with oxygen sources, e.g., percarbonate, perborate, persulfate, hydrogen peroxide, etc. They are used for "solution bleaching," i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT International Application WO 89/099813, published Oct. 19, 1989, by O. Kirk, assigned to Novo Industries A/S.

A wide range of enzyme materials and means for their incorporation into synthetic detergent compositions are also disclosed in U.S. Pat. No. 3,553,139, issued Jan. 5, 1971 to McCarty et al. Enzymes are further disclosed in U.S. Pat.

No. 4,101,457, Place et al, issued Jul. 18, 1978, and in U.S. Pat. No. 4,507,219, Hughes, issued Mar. 26, 1985, both. Enzyme materials useful for liquid detergent formulations, and their incorporation into such formulations, are disclosed in U.S. Pat. No. 4,261,868, Hora et al, issued Apr. 14, 1981. Enzymes for use in detergents can be stabilized by various techniques. Enzyme stabilization techniques are disclosed and exemplified in U.S. Pat. No. 3,600,319, issued Aug. 17, 1971 to Gedge, et al, and European Patent Application Publication No. 0 199 405, Application No. 86200586.5, published Oct. 29, 1986, Venegas. Enzyme stabilization systems are also described, for example, in U.S. Pat. No. 3,519,570.

Other components which are commonly used in detergent compositions and which may be incorporated into the detergent tablets of the present invention include chelating agents, soil release agents, soil antiredeposition agents, dispersing agents, brighteners, suds suppressors, fabric softeners, dye transfer inhibition agents and perfumes.

EXAMPLES

The following process took place according to the invention:

Tablets are flow wrapped two by two in a film using a film wrapping process. Indeed, in a preferred embodiment according to the invention, the packaged tablet comprises at least 1.5% per weight of plastic material, more preferably at least 2% per weight, and less than 3% per weight of plastic material, preferably less than 2.5% per weight. These flow-wrapped tablets are fed via a first sifter inlet into a first feed auger at a rate of 200+/+100kg/h. The first feed auger conveys the packaged tablets into a cylindrical sifting chamber where the packaged tablets are picked up by a rotating paddle assembly and thrown centrifugally against the first sieve screen having apertures of a size of 8 mm. Blades on the paddle assembly are set in a helix configuration to carry the material along the entire length of the first sieve screen. The product below the sieve size which passed through the screen is collected at a main sifter outlet. This is the intermediate material. To ensure separation of powder from plastic, the intermediate material from the first sifter is fed to a second sifter similar to the first one but with a nylon sieve of 2.4–3.5 mm, here again a second feed auger conveying the product into the second cylindrical sifting chamber where it is picked up by a rotating paddle assembly and thrown centrifugally against the second sieve screen. Blades on the paddle assembly carry the material along the entire length of the sieve screen. The product below the sieve size which passed through the screen is collected at the main sifter outlet. This is the obtained powder. The rest of the flow-wrapped and oversize of the powder is conveyed to the end of the sifting chamber and is discharged through a separate smaller outlet.

Equipment specifications: Both sifter casings are fabricated from carbon steel epoxy resin coated. Motor, couplings and bearings are located outside the process area so do not come into contact with the product. Drive shafts made with stainless steel carries both the feeder auger and the paddle assembly. The design of the sieve screen frame for the first sifter is a 3 ring 3-steel strut all welded or bolted construction in carbon steel or stainless steel whilst for the second sifter is a full length sieve screen of nylon.

Product specifications: We have used the centrifugal sifter for flow-wrapped rectangular tablets. Dimensions of tablets are:

weight: 53+/−2 g diameter: 54 mm, height 21.5+/−0.25 mm strength of the tablets: 35+/−4 Kpa Chemical composition A of the tablets without coating is as follows:

| | Composition A (% per weight) |
|---|---|
| Anionic Agglomerates 1 | 21.45 |
| Anionic Agglomerates 2 | 13.00 |
| Cationic Agglomerate | 5.45 |
| Layered Silicate | 10.8 |
| Sodium percarbonate | 14.19 |
| Bleach activator agglomerates | 5.49 |
| Sodium carbonate | 13.82 |
| EDDS/Sulphate particle | 0.47 |
| Tetrasodium salt of Hydroxyethane Diphosphonic acid | 0.73 |
| Soil Release Polymer | 0.33 |
| Fluorescer | 0.18 |
| Zinc Phthalocyanide sulphonate encapsulate | 0.025 |
| Soap powder | 1.40 |
| Suds Suppressor | 1.87 |
| Citric acid | 7.10 |
| Protease | 0.79 |
| Lipase | 0.28 |
| Cellulase | 0.22 |
| Amylase | 1.08 |
| Binder Spray-on-system | 1.325 |
| TOTAL | 100.00 |

Anionic agglomerates 1 comprise of 40% anionic surfactant, 27% zeolite and 33% carbonate.

Anionic agglomerates 2 comprise of 40% anionic surfactant, 28% zeolite and 32% carbonate.

Cationic agglomerates comprise of 20% cationic surfactant, 56% zeolite and 24% sulphate.

Layered silicate comprises of 95% SKS 6 and 5% silicate.

Bleach activator agglomerates comprise of 81% TAED, 17% acrylic/maleic copolymer (acid form) and 2% water.

Ethylene diamine N,N-disuccinic acid sodium salt/Sulphate particle comprise of 58% of Ethylene diamine N,N-disuccinic acid sodium salt, 23% of sulphate and 19% water.

Zinc phthalocyanine sulphonate encapsulates are 10% active.

Suds suppressor comprises of 11.5% silicone oil (ex Dow Corning); 59% of zeolite and 29.5% of water.

Binder spray-on system comprises of 50% Lutensit K-HD 96 and 50% PEG (polyethylene glycol).

Production of the tablet:

i) The detergent base powder of composition A (see table above) was prepared as follows: all the spray-ons were carried out for the particulate material of base composition A in a spraying drum before being mixed together in a mixing drum to form a homogenous particulate mixture.

ii) Tablets were then made the following way: 53 g of the mixture was introduced into a mould of the appropriate circular or rectangular shape and compressed.

iii) Tablets were dipped in a bath comprising 80 parts of sebacic acid mixed with 20 parts of Nymcel zsb16. The time the tablet was dipped in the heated bath was adjusted to allow application of 3 g of the described mixture on it. The tablet was then left to cool at room temperature of 25 C for 24 hours.

The obtained powder and the intermediate material had a granular structure comparing to the granular structure of the original matrix A as follows:

| Mesh Size (μm) | Original Mixture (% per weight deposited on the respective sieve) | Intermediate material (% per weight deposited on the respective sieve) | Obtained powder (% per weight deposited on the respective sieve) |
|---|---|---|---|
| 1180 | 9.66 | 24.5 | 8.9 |
| 850 | 24.59 | 32.7 | 20.9 |
| 450 | 64.65 | 76.9 | 70.3 |
| 250 | 91.29 | 91.3 | 88.1 |
| 150 | 96.64 | 96 | 95 |
| through 150 | 3.36 | 4 | 5 |
| Mean Particle Size | 500 μm | 638 μm | 541 μm |

The above table should be read as follows:

The obtained powder has 8.9% per weight of material which stays on the 1180 micrometer sieve, which compares to 9.66% per weight of the original mixture obtained after step i) above which stays on the 1180 micrometer sieve. The 6 sieves (1180, 850, 450, 250 and 150 micrometer) are placed the one onto the other, the larger mesh size on top and the smaller mesh size on the bottom, so that the granular structure can be analysed. The percentage per weight of particles which go through all sieves, i.e. the "through 150" represents the percentage per weight of fine particles. The table above also indicates the mean particle size for the material considered.

It should be noted that the level of fine particles passing through the 150 micrometer sieve is below 6% per weight for the obtained powder, and is less than twice the percentage per weight of particles passing through the 150 micrometer sieve and comprised in the original powder or original mixture. It should be noted that the tablet submitted to the process according to the invention and described in this example has a coating, the obtained powder compared to the original powder or mixture used for making the tablet without coating. The process also applies to non coated tablets.

It should also be noted that the 6 sieves above are introduced to define the level of fine particles obtained in the obtained recycled powder, and are usually different from the means used in the second or fourth step of sifting.

Less than 0.01% per weight of plastic film residues were found at the end of the second sifter in the obtained powder.

What is claimed is:

1. A process for producing a detergent powder from a packaged tablet, the package comprising plastic materials, whereby the process comprises a first step of submitting the packaged tablet to mechanical degradation with first mechanical degradation means, a second step of sifting with first sifting means to obtain an intermediate material, a third step of submitting the intermediate material to mechanical degradation with second mechanical degradation means, and a fourth step of sifting with second sifting means to obtain the powder, whereby the powder obtained comprises less than 0.05% per weight of plastic material.

2. A process according to claim 1, whereby the tablet is obtained by compressing an original powder.

3. A process according to claim 2, whereby the powder obtained comprises a percentage per weight of particles passing through a 150 micro meter sieve which is less than twice the percentage per weight of particles passing through a 150 micrometer sieve in the original powder.

4. A process according to claim 1, whereby the powder obtained is added to an original powder to form a mixture, the added powder constituting at least 1% and up to 20% per weight of the mixture, the mixture being compressed to form a tablet.

5. A process according to claim 1, whereby the powder obtained comprises less than 4% per weight of particles passing through a 150 micrometer sieve.

6. A process according to claim 1, whereby the tablet has a tensile strength of less than 100 kiloPascal.

7. A process according to claim 1, whereby the mechanical degradation is provided by centrifugation.

8. A process according to claim 1, whereby the packaged tablet comprises at least 1.5% per weight of plastic material.

9. A process according to claim 1, whereby the tablet comprises a surfactant.

10. A process according to claim 1, whereby the package is a flow wrapped film made of thermoplastic resins.

* * * * *